United States Patent [19]

Duncan et al.

[11] 4,145,869

[45] Mar. 27, 1979

[54] SLUB YARN AND METHOD OF FORMING SAME

[75] Inventors: William J. Duncan; Michael H. Mainz, both of Chattanooga, Tenn.

[73] Assignee: E. I. Du Pont de Nemours and Company, Wilmington, Del.

[21] Appl. No.: 845,130

[22] Filed: Oct. 25, 1977

Related U.S. Application Data

[63] Continuation-in-part of Ser. No. 818,083, Jul. 22, 1977, abandoned, which is a continuation-in-part of Ser. No. 750,638, Dec. 15, 1976, abandoned.

[51] Int. Cl.[2] ..... D02G 3/34; D02G 1/16

[52] U.S. Cl. ..... 57/207; 28/271; 57/208; 57/238; 428/399; 57/248; 57/350

[58] Field of Search ..... 57/34 R, 34 B, 140 J, 57/157 R, 157 F; 28/271; 428/362, 364, 369, 397, 399, 400

[56] References Cited

U.S. PATENT DOCUMENTS

| | | | |
|---|---|---|---|
| 2,878,548 | 3/1959 | Lohr et al. | 428/399 X |
| 3,104,516 | 9/1963 | Field | 57/140 J X |
| 3,116,589 | 1/1964 | Edwards et al. | 57/34 B |
| 3,174,271 | 3/1965 | Edwards et al. | 57/140 J |
| 3,296,785 | 1/1967 | Hardy | 57/34 B |
| 3,403,501 | 10/1968 | Nuissl | 57/34 B X |
| 3,457,715 | 7/1969 | Eldridge et al. | 57/34 B X |
| 3,474,613 | 10/1969 | Joarder | 57/140 J X |
| 3,701,248 | 10/1972 | Gray | 28/271 X |
| 3,812,668 | 5/1974 | Wilson | 57/157 F |

*Primary Examiner*—Donald Watkins

[57] ABSTRACT

There is disclosed a variable denier, multifilament yarn having a slub yarn plied with a carrier yarn and displaying high weaving performance. The yarn is characterized by a certain slub size distribution, a certain minimum number of slubs, a specified maximum number of large slubs, less than one tight spot per meter and a coherency factor of from about 4–14, said coherency factor increasing as the number of large slubs increases. A process for making the yarn is also disclosed and includes the features of feeding both feed yarn and carrier yarn to a supply jet, the feed yarn being overfed while the carrier yarn is maintained under zero net overfeed, forwarding the carrier yarn to a slub jet and forwarding the feed yarn to a foraminous surface where slubs are created and thereafter combining both yarns and passing them sequentially through a slub jet, at least one interlacing jet and, optionally, a torque jet.

9 Claims, 1 Drawing Figure

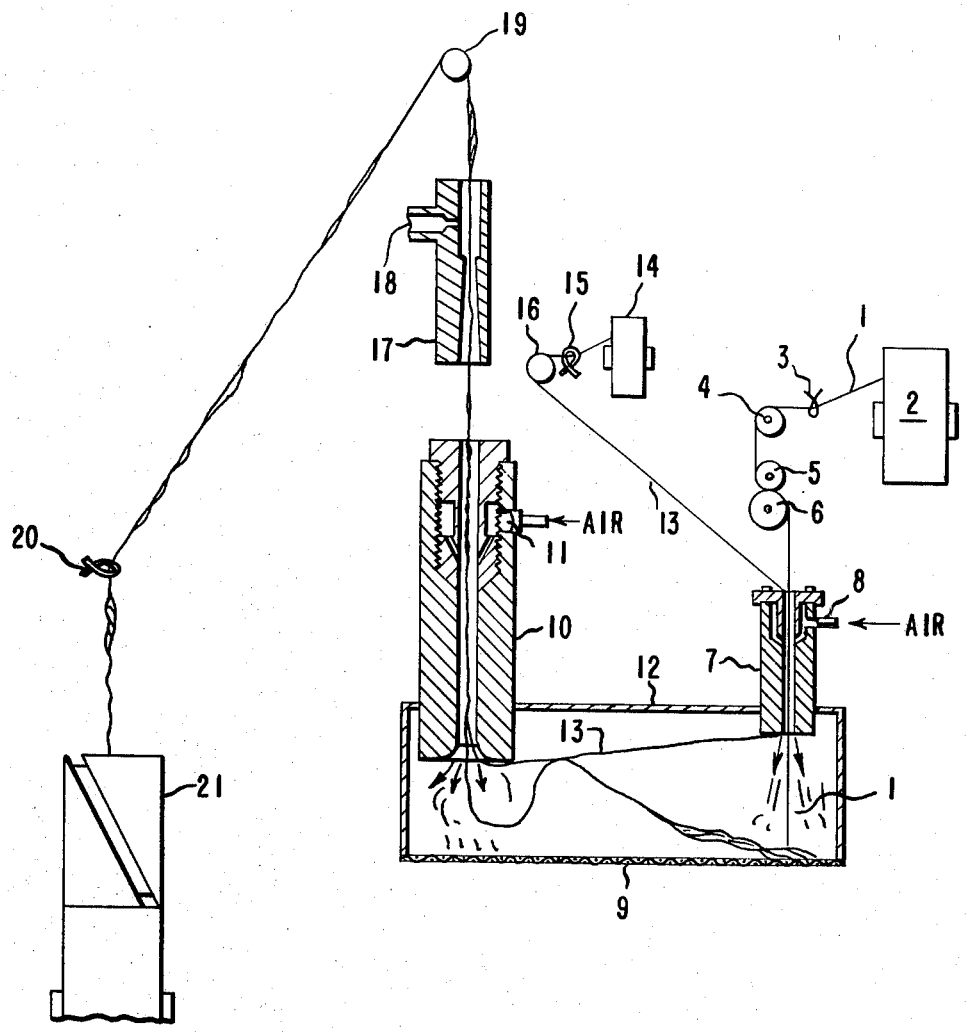
19
18
17
16
15
14
1
3
4
2
5
6
13
AIR
11
20
10
8
AIR
12
7
13
1
21
9

SLUB YARN AND METHOD OF FORMING SAME

CROSS REFERENCE TO RELATED APPLICATION

This application is a continuation-in-part of our application Ser. No. 818,083, filed on July 22, 1977, which is a continuation-in-part of application Ser. No. 750,638, filed on Dec. 15, 1976, both now abandoned.

BACKGROUND OF INVENTION

This invention relates to a slub yarn and a process of making the same. In particular, this invention relates to a slub yarn plied with a carrier yarn, the combined yarn having high weaving performance, and a process for making it.

Slub yarns are well known in the prior art and are characterized by variations in cross section along the length of the yarn. Such yarns have been made from continuous filaments, from staple fibers and from mixtures of continuous filaments in which tufts have been incorporated, i.e., by twisting, into the continuous filament structure. When made into fabric, such yarns provide a decorative effect of slubs distributed throughout the surface of the fabric.

For some purposes, it is desirable to produce yarns having large variations in denier, particularly, with the large denier segments continuing for a considerable length along the yarn in order to obtain novel effects in fabrics for such purposes as casement fabrics, draperies, dress goods, upholstery fabrics, and the like. One of the most satisfactory yarns for such purposes in the past has been that obtained from the imperfect, freak, or double cocoons, or from cocoons of uncultivated silkworms which form imperfect silk threads. These silk yarns, called doupioni silk, are irregular and carry slubs of a thickened nature of a considerable length in an irregular fashion.

U.S. Pat. No. 3,174,271, issued to Edwards et al. on Mar. 23, 1965, discloses a variable denier multifilament yarn comprising portions of a substantially uniform base denier and an average of at least 50 slubs, per 1,000 yards (914 meters) of yarn, of continuous synthetic filaments looped upon themselves and consolidated into the yarn by filament entanglement, the slubs being of random size and distribution along the yarn, the average slub length being at least 10 inches (25.4 cm), about 10% to 30% of the slubs having lengths greater than twice the average, the slubs having an average denier ratio of at least 3.0, and about 5% to 65% of the slubs having a segment with a denier ratio of at least 10. The patent discloses that a carrier yarn can be used and that when making the slub yarn combined with a carrier yarn, the carrier yarn can be introduced at either the feed, slub, or torque jet.

U.S. Pat. No. 3,116,589, issued to Edwards et al. on Jan. 7, 1964, discloses a process for making the slub yarn of the U.S. Pat. No. 3,174,271. The process comprises continuously feeding the yarn to a supply jet, forwarding the yarn through the supply jet with a high velocity stream of compressible fluid, forwarding the yarn in the stream to impinge against a foraminous surface at an angle, continuously withdrawing the yarn from the surface at a rate at least 5% less than the rate of feed, directing a second high velocity stream of compressible fluid from a slubbing jet against the foraminous surface so that the yarn passes through the stream in a countercurrent direction to produce slubs composed of yarn loops consolidated into the yarn by filament entanglement, and collecting the slub yarn.

U.S. Pat. No. 3,296,785, issued to Hardy on Jan. 10, 1967, discloses a process for producing a slub yarn plied with a carrier yarn which comprises continuously feeding a multifilament yarn to a supply jet and forwarding the yarn in a high velocity stream of compressible fluid onto a screen surface; directing a second high velocity stream of compressible fluid from a slub jet against the screen surface to provide a turbulent zone between the two streams adjacent to the screen surface; interlacing slubs in the yarn by continuously withdrawing the yarn from the screen surface through the turbulent zone and through the slub jet in a direction countercurrent to the stream; continuously feeding a carrier yarn to the slub jet and combining the two yarns; then false twisting the combined yarns with a high velocity single vortex stream of compressible fluid, by passing the yarns through a torque jet; and interlacing the yarn plies with a high velocity, plural vortex stream of compressible fluid, by passing the combined yarns through an interlacing jet, to form a plied yarn of slub yarn and carrier yarn. The patent discloses that with respect to the torque jet and the interlacing jet either jet can precede the other. The Hardy patent describes the weaving problems which results with the use of slub yarns and indicates that the disclosed process provides a slub yarn of improved weaving performance.

U.S. Pat. No. 3,474,613, issued to Joarder et al. on Oct. 28, 1976, discloses an improved process of making an improved slub yarn which comprises the addition of a flow restricting element to the lower surface of the screen that coincides with the area where the yarn is deposited by the feed jet when using a slub process such as those set forth in U.S. Pat. Nos. 3,296,785 and 3,116,589. The product made by the disclosed process is a variable denier multifilament yarn comprising portions of substantially uniform denier and characterized by having at least 120 slubs per 1,000 yards, about 40–95% of said slubs having a segment with a denier ratio greater than about 7, about 1–10% of said slubs having a segment with a denier ratio greater than about 25, less than 1% of said slubs having a segment with a denier ratio greater than about 40.

Commercialization of some of the prior art processes has been difficult or unsuccessful. Moreover, it has been found that, when using certain of the above-described prior art processes, upon increase of productivity from less than about 366 m/min (400 yds/min) to 548–731 m/min (600–800 yds/min) the control of the slub distribution, the number of large slubs, and the cohesion of the combined yarn becomes more difficult as the productivity rate increases. Accompanying this loss of control is a decrease in the weaving performance of the resulting slub yarn. A process which provides at a high rate of productivity a slub yarn having good weaving performance and the resulting slub yarn made by said process would represent a highly desirable commercial advance. Furthermore, a slub yarn that provides the weaving performance which approaches that of an unslubbed yarn without an increase in fabric flashes or loss of fabric visual slub aesthetics would constitute a remarkable improvement over prior art material.

SUMMARY OF THE INVENTION

One aspect of the present invention is a variable denier, multifilament yarn having high weaving performance and having a slub yarn plied with a carrier yarn, said yarn having compact portions of substantially uniform denier and from about 120–800 slubs per 914 meters, said slubs being randomly distributed along said yarn; about 20–95% of said slubs having a segment with a denier ratio greater than about 7; and less than 1% of said slubs having a segment with a denier ratio greater than about 40; said yarn being further characterized by having no more than 30 slubs with a denier of 1500 or greater per 914 meters of yarn, no more than one tight spot per meter, and a coherency factor for combined yarn between slubs of from about 4–14, said coherency factor increasing as the number of large slubs increases.

Another aspect of the present invention is a process for making the disclosed yarn, said process consisting essentially of continuously feeding a carrier yarn and a multifilament feed yarn to a supply jet, said feed yarn being from about 3–70% overfed to said supply jet and said carrier yarn being under zero net overfeed; forwarding the carrier yarn directly to a slub jet and forwarding the feed yarn in a high velocity stream of compressible fluid onto a foraminous surface of substantially uniform porosity, directing a second high velocity stream of compressible fluid from the slub jet against the foraminous surface to provide a turbulent zone between the two steams adjacent to the foraminous surface; entangling slubs in the combined yarns by continuously withdrawing the feed yarn from the foraminous surface through the turbulent zone and by passing the combined yarns through the slub jet in a direction countercurrent to the stream coming therefrom; and passing the combined yarns through at least one interlacing jet and entangling the yarn plies with a high velocity stream of compressible fluid directed at the axis of the yarn channel of said jet, the pressure of the fluid in the interlacing jet being from about 2.1–3.5 kg/cm$^2$ gage (30–50 psig). Optionally, the combined yarns are then false twisted by passing the yarns through a torque jet in which a high velocity stream of compressible fluid is directed tangentially into the yarn channel of said jet. The torque jet is preceded by a twist trap.

BRIEF DESCRIPTION OF THE DRAWING

The drawing is a diagrammatic representation of a preferred embodiment of the process of the invention. The jet devices are shown in cross section taken through the yarn passageways.

DETAILED DESCRIPTION OF THE INVENTION

The yarn of the invention has a slub yarn plied with a carrier yarn, has high weaving performance, has compact portions of substantially uniform denier and is characterized by having from about 120–800 slubs per 914 meters (1000 yards), said slubs being randomly distributed along said yarn; about 20–95% of said slubs having a segment with a denier ratio greater than about 7, and less than 1% of said slubs having a segment with a denier ratio greater than about 40. The yarn of the invention is further characterized by having no more than 30 slubs with a denier of 1500 or greater per 914 meters (1000 yards) of yarn, no more than one tight spot per meter, and a coherency factor for the combined yarn between slubs of from 4–14, said coherency factor increasing as the number of large slubs, i.e., slubs of a denier of 1500 or greater, increases. Preferably, the yarn of the invention has no more than 20 large slubs per 914 meters, a coherency factor of from about 5–10, and from about 150–500 slubs per 914 meters.

Slub yarns are used as fill in certain woven fabrics. Often when so used, highly entangled sections of yarn, called tight spots, produce voids which appear as specks of light (flashes) in transmitted light, thereby resulting in unpleasing fabric aesthetics. The slub yarn of the invention has no more than one tight spot per meter. A level of tight spots substantially above this value can result in unpleasing woven fabric aesthetics due to too high a frequency of fabric flashes. Moreover, it has been found that, if the number of large slubs is greater than 30 per 914 meters, a slub yarn having good weaving performance can be achieved only at the sacrifice of flash aesthetics in a fabric made therefrom because of the corresponding requirement that the coherency factor of the base yarn be increased.

The term "slub" as used herein refers to a readily discernable, stable enlargement of the combined yarn having a length of at least 0.64 centimeter. Smaller enlargements on the combined yarn are difficult to evaluate and make no contribution to the present invention. In the yarn of the invention the slubs are randomly distributed along the yarn, i.e., the slub distribution does not form any distinctive repetitive pattern. Regions of the yarn between slubs are compact in the sense that these portions are not bulky or textured.

The measure of slub thickness used herein is the denier ratio. The term "denier ratio" as used herein means the ratio of the denier of the slub to the denier of the feed yarn. The expression "feed yarn" as used herein refers to the component yarn used to produce slubs. In general, the plied yarn of the invention does not have slubs of uniform denier throughout their length. Hence, the maximum denier occurring in a given slub is used as the denier of that slub.

Synthetic continuous filament yarns which can be used to make the slub yarn component of the plied yarn of the invention include those made from fiber-forming polyamides, such as 6 nylon, 66 nylon, and 6–10 nylon; from fiber-forming polyesters of terephthalic acid or isophthalic acid and a lower glycol, such as poly(ethylene terephthalate) and poly(hexahydro-p-xylene terephthalate); and from regenerated cellulose, cellulose esters and acrylic, vinyl, and vinylidene polymers.

A preferred material for making the yarn of the invention is the fiber-forming polyamide prepared from bis(4-aminocyclohexyl) methane or ethane and a saturated dicarboxylic acid having 9–16 carbon atoms in a straight chain. Preferably, the acid will be dodecanedioic acid and the polymer will be prepared using bis(4-aminocyclohexyl) methane containing 70–100% by weight of the trans-trans stereoisomer. This polyamide has a weight average molecular weight of at least 8,000, and more preferably at least 15,000. A highly preferred material for use as the slub yarn component is a mixed shrinkage yarn having homopolymer filaments prepared from bis(4-aminocyclohexyl) methane containing 70% by weight of the trans-trans stereoisomer and dodecanedioic acid and copolymer filaments prepared from said bis(4-aminocyclohexyl) methane and a mixture of dodecanedioic and isophthalic acids such that about 10 mol percent of the copolymer is due to isophthalate units. This yarn can be prepared by spinning filaments of the homopolymer and copolymer from separate holes in a single spinneret as described in Knospe, U.S. Pat. Nos. 3,416,302 and 3,481,113. The preferred yarn is characterized by a high level of tensile properties at both room and elevated temperatures, outstanding stain resistance and excellent dimensional stability over a broad range of conditions.

The carrier yarn can be any of the foregoing yarn or can be nylon, a polyester yarn or any other suitable yarn material. Preferably, the feed yarn and the carrier yarn of the plied yarn of the invention are continuous, multifilament yarns having zero twist. The feed yarns can have filaments with various cross sections, such as round, trilobal, cruciform and the like.

Yarns of various denier per filament can be employed as either the carrier or the slub component and more than one yarn can be used for either. In a preferred embodiment of the invention the slub and carrier components have a low denier, e.g., less than about 60 denier, and/or low denier per filament because fabric produced therefrom exhibits a reduced tendency for loops present in the regions between slubs to protrude from the fabric surface. Such protrusion imparts to the fabric undesirable loopiness or graininess. When the denier of the feed yarn used to make the slub yarn component is reduced, the rate at which this yarn is overfed should be increased to maintain a desired slub size distribution.

In describing the process of the invention the yarn used to form the slub component of the yarn of the invention will be called the "multifilament yarn" or "feed yarn". This terminology will be used for this component until the stage at which it becomes a slub yarn. The carrier yarn will be referred to as such although it is to be understood that it too is a multifilament yarn. In the process of the invention a multifilament yarn and a carrier yarn are fed to a supply jet wherein the yarns are forwarded by a high velocity stream of compressible fluid. The multifilament yarn is overfed to the supply jet and is forwarded by the stream of compressible fluid onto a foraminous surface of substantially uniform porosity, such as a screen. By "substantially uniform porosity" it is meant that the surface does not have adjacent areas of different porosity. The carrier yarn is fed to the supply jet under zero net overfeed and is forwarded therefrom directly to a slub jet. A second stream of high velocity fluid formed by the slub jet impinges upon the screen thereby forming, adjacent to the screen, a turbulent zone between said second stream and the first stream. The turbulent zone between the two streams causes loops and folds to form in the multifilament yarn. Suitable supply jets include jets having both forwarding and entangling actions. A supply jet pressure of from about 0.7–1.8 kg/cm$^2$ gage (10–25 psig) is suitable for the present process.

Although the process of the invention is not limited by or dependent upon any theory, it is thought that entanglement of the feed yarn with the carrier yarn occurs in the supply jet. As the carrier yarn passes directly from the supply jet to the slub jet, it randomly causes additional removal of feed yarn from the screen due to the entanglement of the two yarns. This additional removal of feed yarn from the screen helps to maintain a low level of large slubs in the product of the invention.

The size of slubs in the product of the invention can be regulated by altering conditions which promote entangling in the supply jet. Such conditions include the carrier yarn tension and the supply jet pressure. Reducing the carrier yarn tension or increasing the supply jet pressure decreases the number of large slubs and increases the number of small slubs. The tension on the carrier yarn as it enters the supply jet is preferably 0.02–0.08 gram per denier.

After passing through the zone of turbulence the multifilament yarn is withdrawn from the foraminous surface at a controlled rate which is lower than its rate of feeding thereto, is combined with the carrier yarn, and is passed through the slub jet in a direction countercurrent to the high velocity streams issuing therefrom. The slub jet consolidates the loops and folds into slubs thereby forming the slub component of the combined yarn of the invention and entangles this component with the carrier yarn. Suitable slub jets include jets of the interlacing type in which opposed pairs of streams are directed into the yarn passageway. A slub jet pressure of from about 0.7–4.2 kg/cm$^2$ gage (10–60 psig) is suitable for the present process. The slub yarn is withdrawn from the foraminous surface at a rate so as to give, relative to its feed rate, a percent overfeed of from about 3–70%, and preferably 5–20%. Percent overfeed is defined as $$\% \text{ overfeed} = \frac{\text{feed rate} - \text{withdrawal rate}}{\text{withdrawal rate}} \times 100$$

The combined yarn is then passed to at least one interlacing jet wherein the yarn plies are entangled. Preferably, the combined yarn is passed through two interlacing jets, each of which have a single fluid conduit, so that a somewhat lower air pressure, than used with a single jet, can be employed. Thereby the avoidance of tight spots in the yarn can be facilitated. The resulting plied yarn is the product of the invention.

Optionally, the combined yarn is then false twisted by passing it through a torque jet which provides a high velocity stream of compressible fluid directed tangentially into the yarn channel of the jet. When a torque jet is used, it is preceded by a twist trap. False twisting can also be effected by mechanical means and can improve the cohesiveness of the combined yarn while also diminishing extraneous loops. Suitable fluid pressure for the interlacing and torque jet is from about 2.1–3.5 kg/cm$^2$ gage (30–50 psig). Pressure greater than 3.5 kg/cm$^2$ gage (50 psig) in the interlacing jet can cause too many flashes in the fabric made from the resulting yarn. However, for yarns of 240 denier or greater pressures up to about 4.2 kg/cm$^2$ gage (60 psig) can be used whereas for yarns of about 130 denier or less pressures somewhat lower than 2.1 kg/cm$^2$ gage (30 psig) may be suitable.

Referring to the drawing, a substantially zero twist, multifilament yarn 1 is withdrawn from supply package 2 through pigtail guide 3 and over snub guide 4 to feed rolls 5 and 6. Passage of the yarn through the nip formed by idler roll 5 which is rubber-covered and driven feed roll 6 provides positive control of the feed rate. A carrier yarn 13 from package 14 is passed through guide 15 and over snub guide 16. The carrier yarn and the multifilament yarn are passed then jointly through supply jet 7 and are forwarded by a high-velocity stream created by air introduced into the jet through fitting 8. The carrier yarn which is maintained under zero net overfeed and preferably at controlled positive tension is passed directly to slub jet 10. The multifilament yarn 1 is forwarded to strike against a foraminous surface, so that the yarn is deposited on the foraminous surface and the air passes through the surface. A slub jet 10 is supplied with air under pressure through fitting 11 to form a high velocity stream which is also directed perpendicularly against the foraminous surface 9 to impinge on the surface adjacent to the stream from the supply jet 7. A turbulent zone is created between the two streams and causes the multifilament yarn to twist, loop, and entangle itself. Preferably, the foraminous surface 9 is completely enclosed at the sides and top to form a basket 12 which guides the multifilament yarn through the turbulent zone during slub formation. The sides and top can be constructed from any material which will retain the yarn and can be either perforated or solid. Suitable material includes screening, plastic and sheet metal. The supply and slub jets are mounted at the top of the box-like enclosure. The multifilament yarn is passed from the foraminous surface and then together with the carrier yarn is passed through slub jet 10 in a direction countercurrent to the high-velocity stream passing through this jet. The resulting combined yarn is passed from jet 10 to interlacing jet 17, supplied with air under pressure through fitting 18, where the yarns are entangled by the air stream which is directed toward the axis of the yarn channel of jet 17. The combined yarn then is passed around roller guide 19 through pigtail guide 20 and to a conventional windup 21 which can be a package surface-driven by a self-traversing drive roll. The exit of supply jet 7 and the entrance of slub jet 10 are preferably rounded so as to minimize damage to carrier yarn 13.

The process of the invention provides a method of making a combined yarn having a slub yarn plied with a carrier yarn. The yarn of the invention has improved weaving performance and is characterized by a low-frequency of large slubs, good bundle cohesion and a low level of tight spots. It has been found that if the carrier yarn is not fed through the supply jet along with the slub yarn but is fed into the slub jet instead, a yarn with the above features is not obtained, the number of large slubs being significantly greater and either the bundle cohesion being appreciably less or the number of tight spots being significantly greater. The product of the invention gives high weaving performance, i.e., less than one break per 10,000 picks woven with acceptable fabric flash aesthetics. Weaving performance of the product of the invention approaches that of unslubbed or wrapped yarn. The product of the invention gives fabric with doupioni aesthetics and is useful primarily in Shantung, a woven fabric in which slub yarn is used in the fill direction and unslubbed yarn in the warp. The yarn of the invention is also useful as warp yarn in linen-type fabrics and can be used in knitting; however, for the latter use a reduced level of large slubs, e.g., up to 5 per 914 meters, is usually required.

Test Procedures

Tight spots in the yarn of the invention are measured by use of a tray of water to disperse the yarn bundle, thereby allowing identification of tight nodes. The nodes are visually counted as the yarn is drawn manually through a trough of water. With certain mixed shrinkage yarns of the invention, heat setting the yarn at 180° C. for 2 minutes under a 4 mg/denier load facilitates the identification of tight spots.

The slub yarn of the invention can be characterized by a manual operation or by the use of equipment designed to make various length and thickness measurements on the slubs of the yarn. It is believed that the manual and instrumental length measurements will not differ from each other by more than 10%. One suitable apparatus for characterizing the length and maximum denier of the slubs in the slub yarn of the invention is referred to as a Slub Analyzer and is described in Faulhaber, U.S. Pat. No. 3,887,814 which description is incorporated herein by reference.

The coherency factor as used herein is a measure of bundle cohesion and is determined by a modification of the hook-drop test described in Bunting et al., U.S. Pat. No. 2,985,995. The test as used herein is modified to measure the degree of entangelement in the compact portion of the combined yarn between slubs. The yarn bundle is suspended from a sharp hook mounted at the top of a meter stick. A 20 g. weight with an identical hook is inserted into the yarn split and allowed to pull gently downward. The distance the weight moves is recorded. The yarn is advanced about one meter and the test is repeated until ten measurements have been made. The average of these measurements is taken as the node-to-node distance for the combined yarn between slubs. This distance in centimeters is divided into 100 to obtain the coherency factor.

In calculating denier ratio, the denier of the combined yarn, i.e. feed yarn plus carrier yarn, between slubs is determined, using regions where both the feed yarn and carrier yarn filaments are substantially straight. Then a slub region is dissected, the looped and tangled feed yarn filaments being readily distinguishable from the straight load-bearing carrier filaments when the yarn is tensioned, and the denier of the carrier yarn is determined. The difference between the denier of the combined yarns between slubs and the carrier yarn within the slub is the denier of the feed yarn. This value is then used to calculate "denier ratio" as described hereinbefore.

The invention is further described by the following examples.

EXAMPLE 1

An apparatus similar to that shown in the drawing is used to prepare a yarn of the invention. A 60 denier, 36 filament mixed shrinkage yarn having filaments with a trilobal cross-section is used as the feed yarn for making the slub component. This yarn has homopolymer filaments prepared from bis(4-aminocyclohexyl) methane having a trans-trans stereoisomer content of 70% by weight and dodecanedioic acid and copolymer filaments prepared from the same diamine and a mixture of dodecanedioic and isophthalic acids such that about 10 mol precent of the copolymer is due to isophthalate units. The feed yarn is delivered to the supply jet at 640 meters (700 yards) per minute. Compressed air is introduced into the supply jet at a pressure of 1.3 kg/cm$^2$ gage (18 psig) and forwards the feed yarn onto a screen having abot 1225 openings per 6.5 cm$^2$. A carrier yarn is formed from two packages of 30 denier, 18 filament mixed shrinkage yarn having filaments with trilobal cross-section and having a polymer composition similar to that of the feed yarn. Each package has its associated guide 15 and snub guide 16. The two yarns which form the carrier yarn are each under a tension of 0.03–0.05 gpd and meet at the entrance of the supply jet. The carrier yarn is passed through the supply jet and is forwarded directly to the slub jet. A high velocity stream of compressed air at a pressure of 2.1 kg/cm$^2$ gage (30 psig) is fed to the slub jet and impinges on the screen. The feed yarn forms loops and folds in the turbulent zone created by the two air streams and then is withdrawn from the screen at a rate which provides a 10.2% overfeed of said yarn. The feed yarn is combined with the carrier yarn and both yarns are passed through the slub jet in a direction countercurrent to the high velocity stream of air issuing therefrom. The resulting combined yarn is passed through an interlacing jet having a high velocity stream of compressed air at a pressure of 3.2 kg/cm$^2$ gage (45 psig) directed at the yarn channel of the jet. The combined yarn is then passed over a roller guide and through a torque jet in which a high velocity stream of compressed air at a pressure of 3.2 kg/cm$^2$ gage (45 psig) is directed tangentially into the yarn channel of the jet.

The resulting product is characterized with a Slub Analyzer similar to that described in U.S. Pat. No. 3,887,814. A number of samples of 457 m (500 yd) each is analyzed and the results are averaged. The yarn is found to have 250 slubs per 914 meters, with about 48% of the slubs having a segment with a denier ratio greater than about 7 and 0.96% of the slubs having a segment with a denier ratio greater than about 40. The yarn has 12.8 slubs per 914 meters with a denier of 1500 or greater, 0.2 tight spots per meter and a coherency factor of 8.5.

This yarn is used as fill, at 58 picks per 2.54 cm., in preparing a fabric on a shuttle loom which is in excellent operating condition. The warp used is prepared from a 60 denier, 36 filament mixed shrinkage yarn having a polymer composition similar to that of the fill yarn. The warp is used at 96 ends per 2.54 cm. During weaving, there are no breaks in 438,000 picks of yarn. The finished fabric has 110 warp ends per 2.54 cm and 70 fill ends per 2.54 cm, has a doupioni aesthetics and displays less than 3 flashes per 100 sq. cm.

EXAMPLES 2, 3 AND COMPARATIVE EXPERIMENTS 1 AND 2

Additional yarns are made using a process similar to that described in Example 1 with the differences noted in Table 1. Properties of the yarns produced are given in Table 1. In Example 2 a torque jet was omitted and a second interlacing jet was employed. Each interlacing jet had a single fluid conduit. In Comparative Experiment 1 the coherency factor of the yarn was low causing the yarn to exhibit excessive breakage during weaving. For purposes of evaluating the yarns, less than 1.0 break per 10,000 picks was taken as an indication of acceptable weaving performance. In Comparative Experiment 2, the yarn is outside of the invention because the number of tight spots per meter and the coherency factor are too high.

TABLE 1

| | Example No. | | Comparative Exp. No. | |
|---|---|---|---|---|
| Process | 2 | 3 | 1 | 2 |
| Feed Yarn (denier/filaments) | 60/36 | 30/18 | 60/36 | 45/20 |
| Carrier Yarn (denier/filaments) | 2 × 30/18 | 30/18 | 2 × 30/18 | 2 × 45/20 |
| % Overfeed | 10.2 | 5.6 | 10.2 | 10.2 |
| Windup Speed mpm (ypm) | 640 (700) | 646 (707) | 640 (700) | 640 (700) |
| Jet Sequence (after slub jet) | interlace/ interlace | interlace/ torque | interlace/ interlace | interlace/ interlace |
| Air Pressure kg/cm$^2$ gage (psig) | | | | |
| Supply jet | 1.3 (18) | 1.3 (18) | 1.3 | 1.3 |
| Slub Jet | 2.1 (30) | 3.5 (50) | 2.1 | 2.1 |
| Interlace (or torque) Jet | 2.5 (35) | 3.2 (45) | 1.8 (25) | 4.2 (60) |
| Yarn Properties | | | | |
| Slubs per 914 meters | 250 | 224 | 242 | 184 |
| Slubs with denier of 1500 or greater | 17.4 | 2 | 13.4 | 2 |
| % of slubs having segment with denier ratio >7 | 44.8 | 23.2 | 47.9 | 27.1 |
| % of slubs having segment with denier ratio >40 | 0.2 | 0 | 0.2 | 0 |
| coherency factor | 5.5 | 4.8 | 3.3 | 18.5 |
| tight spots/meter | 0.45 | 0.2 | 0.15 | 1.5 |
| Weaving & Fabric | | | | |
| no. of picks woven | 20,000 | 32,000 | 19,000 | 6,000 |
| weaving breaks per 10,000 picks | 0 | 0 | 2.1 | 0 |
| fabric flashes per 100 cm$^2$ | 77 | 17 | 15 | 212 |

We claim:

1. A variable denier, multifilament yarn having a slub yarn plied with a carrier yarn, said yarn having compact portions of substantially uniform denier and from about 120–800 slubs per 914 meters, said slubs being randomly distributed along said yarn; about 20–95% of said slubs having a segment with a denier ratio greater than about 7; and less than 1% of said slubs having a segment with a denier ratio greater than about 40; said yarn being further characterized by having no more than 30 slubs with a denier of 1500 or greater per 914 meters of yarn, less than one tight spot per meter, and a coherency factor for combined yarn between slubs of from about 4–14, said coherency factor increasing as the number of large slubs increases.

2. The yarn of claim 1 having no more than 20 slubs of a denier of 1500 or greater per 914 meters of yarn, a coherency factor of from about 5–10, and from about 150–500 slubs per 914 meters.

3. The yarn of claim 1 wherein the slub yarn filaments consist essentially of a fiber-forming polyamide prepared from bis(4-aminocyclohexyl) methane or ethane and a saturated dicarboxylic acid having 9–16 carbon atoms in a straight chain.

4. The yarn of claim 3 wherein the polyamide is prepared from bis(4-aminocyclohexyl) methane having 70–100% by weight of the trans-trans isomer and dodecanedioic acid.

5. The yarn of claim 3 wherein the slub yarn component is a mixed shrinkage yarn consisting essentially of homopolymer filaments prepared from bis(4-aminocyclohexyl) methane having a trans-trans isomer content of 70% by weight and dodecanedioic acid and copolymer filaments prepared from said bis(4-aminocyclohexyl)methane and a mixture of dodecanedioic acid and isophthalic acid, about 10 mol percent of the repeating units of the copolymer being due to isophthalic acid.

6. A process for producing a slub yarn plied with a carrier yarn consisting essentially of continuously feeding a carrier yarn and a multifilament feed yarn to a supply jet, said feed yarn being from about 3–70% overfed to said supply jet and said carrier yarn being under zero net overfeed; forwarding the carrier yarn directly to a slub jet and forwarding the feed yarn in a high velocity stream of compressible fluid onto a foraminous surface of substantially uniform porosity; directing a second high velocity stream of compressible fluid from the slub jet against the foraminous surface to provide a turbulent zone between the two streams adjacent to the foraminous surface;

entangling slubs in the combined yarns by continuously withdrawing the feed yarn from the foraminous surface through the turbulent zone and by passing the combined yarns through the slub jet in a direction countercurrent to the stream coming therefrom;

passing the combined yarns through at least one interlacing jet and entangling the yarn plies with a high velocity stream of compressible fluid directed at the axis of the yarn channel of said jet, the pressure of the fluid in said interlacing jet being from about 2.1–3.5 kg/cm$^2$ gage (30–50 psig).

7. The process of claim 6 wherein the yarn plies are entangled by passing the combined yarns through two interlacing jets, each having a single fluid conduit.

8. The process of claim 7 wherein the feed yarn is withdrawn from the foraminous surface at a rate which provides from about 5–20% overfeed.

9. The process of claim 6 wherein the combined yarn is thereafter false twisted by passing the yarn through a torque jet in which a high velocity stream of compressed air is directed tangentially into the yarn channel of said jet.

* * * * *